US008347592B2

(12) United States Patent
Kean

(10) Patent No.: US 8,347,592 B2
(45) Date of Patent: Jan. 8, 2013

(54) DEVICE FOR MANUFACTURING SANDBAGS

(76) Inventor: Charles Kean, Huntington, NY (US)

( * ) Notice: Subject to any disclaimer, the term of this patent is extended or adjusted under 35 U.S.C. 154(b) by 349 days.

(21) Appl. No.: 12/802,978

(22) Filed: Jun. 17, 2010

(65) Prior Publication Data

US 2011/0011037 A1 Jan. 20, 2011

Related U.S. Application Data

(60) Provisional application No. 61/268,994, filed on Jun. 18, 2009.

(51) Int. Cl.
*B65B 9/06* (2012.01)

(52) U.S. Cl. ..... 53/550; 53/562

(58) Field of Classification Search ..... 53/550, 53/562

See application file for complete search history.

(56) References Cited

U.S. PATENT DOCUMENTS 2,883,813 A * 4/1959 Shannon ..... 53/545
3,538,711 A * 11/1970 Nielsen ..... 405/23
3,958,390 A * 5/1976 Pringle et al. ..... 53/433
4,272,944 A * 6/1981 Suga ..... 53/511
5,491,960 A * 2/1996 Taylor, Jr. ..... 53/568
5,669,732 A * 9/1997 Truitt ..... 405/20
5,893,260 A * 4/1999 McKenna ..... 53/451
6,085,810 A * 7/2000 Castillo et al. ..... 141/391
6,662,528 B2 * 12/2003 Holt et al. ..... 53/417

* cited by examiner

*Primary Examiner* — Hemant M Desai
(74) *Attorney, Agent, or Firm* — Collard & Roe, P.C.

(57) ABSTRACT

An apparatus for constructing sandbags has a movable, floatable platform, and a length of casing disposed in a roll and supported on the platform. The casing has two longitudinal edges and can be unrolled from the roll. There is a hopper for receiving and dispensing a quantity of sand on top of the casing as the casing is unrolled from the roll. The hopper is supported by a crane mounted on the platform, and positioned above the length of casing. There is a device for bringing the longitudinal edges of the casing together after the sand has been deposited, and a stitching machine for stitching the edges of the casing together to form a tube of casing filled with sand. The stitching machine is mounted on the crane above the device for bringing the edges of the casing together. There is a conveyor for conveying the tube away from the stitching machine and off of the platform.

11 Claims, 7 Drawing Sheets

DEVICE FOR MANUFACTURING SANDBAGS

CROSS-REFERENCE TO RELATED APPLICATIONS

This application claims priority under 35 U.S.C. §119(e) of U.S. Provisional Application Ser. No. 61/268,994, filed on Jun. 18, 2009.

BACKGROUND OF THE INVENTION

1. Field of the Invention

This invention relates to a device for automatically manufacturing and filling sandbags, and for depositing them in a desired location. In particular, the invention relates to a pontoon boat containing a crane and conveyors, which automatically creates, fills, and deposits the sandbags as the pontoon boat moves along a desired route.

2. The Prior Art

Sandbags are often used to create a barrier to prevent flood waters from entering a designated area. In general, sandbags are filled by hand and carried by the filler to the desired location. For large floods, this is very time consuming and exhausting, and requires many people to accomplish.

It would be desirable to create a device that can construct, fill, and deposit the sandbags, without requiring manual labor.

SUMMARY OF THE INVENTION

It is therefore an object of the invention to provide a simple way to automatically construct, fill, and deposit a large number of sandbags along a designated area, without requiring a lot of personnel.

This and other objects are accomplished by an apparatus for constructing sandbags comprising a floatable platform, means for moving the floatable platform in a desired direction, and a length of casing disposed in a roll and supported on the platform. The casing has two longitudinal edges and can be unrolled from the roll. There is a hopper for receiving and dispensing a quantity of sand on top of the casing as the casing is unrolled from the roll. The hopper is supported by a crane mounted on the platform, and positioned above the length of casing. There is a device for bringing the longitudinal edges of the casing together after the sand has been deposited, and a stitching machine for stitching the edges of the casing together to form a tube of casing filled with sand. The stitching machine is mounted on the crane above the device for bringing the edges of the casing together. Finally, there is a conveyor for conveying the tube away from the stitching machine and off of the platform.

Preferably, the conveyor is supported by another crane that is adapted to rotate the conveyor between a position where the conveyor has a running direction that is perpendicular to a moving direction of the platform and a position where the running direction is parallel to the moving direction of the platform. This allows the tube of sand to be easily deposited along a shoreline as the platform moves along the shoreline.

To ensure a continuous supply of sand, a second floatable platform is positioned near the first floatable platform. The second floatable platform contains a large quantity of sand and a device for transferring sand to the hopper.

In a preferred embodiment, the floatable platform is supported by pontoons and is configured as a catamaran. Other types of configurations can also be used. The means for moving the platform can comprise a motor, such as an outboard motor. Alternatively, the platform could be pulled by another motorized water vehicle.

The first conveyor has rollers and a belt for receiving the casing from the roll and transporting the casing past the hopper, through the device for bringing the edges of the casing together, and through the stitching machine to the rotatable conveyor, where the completed roll is transported away from the platform to a desired location.

In one embodiment, the device for bringing the edges of the casing together comprises a plurality of hooks connected to the second conveyor belt adjacent to the longitudinal edges of the belt, and a stationary bar mounted below the second conveyor belt. When the belt is moving, the hooks contact the stationary bar and move upward through respective apertures in the belt, and bring the longitudinal edges of the belt together. After the hooks run past the stationary bar, which is mounted below the stitching machine, they pass back through the belt due to gravity and remain there until they encounter the stationary bar again on the next pass around the conveyor. The stationary bar has a tapered front end to prevent the hooks from becoming stuck. The hooks encounter the tapered front end and slide along this end until they reach the full width of the stationary bar, at which point they are fully extended through the belt.

In another embodiment, the device for bringing the edges of the casing together comprises a structure having a flat substantially trapezoidal bottom, two non-parallel side walls and two open ends, with one open end being wider and the other open end being narrower, so that casing entering the structure from the wider end is squeezed together as it exits the narrower end and the ends of the casing are brought together. This device is disposed immediately above the conveyor and initially, the end of the casing is fed into the device, and the remaining casing travels through this device as it unrolls from the roll. The weight of the sand on the casing keeps the casing stable and allows the device to push the casing into a shape where the edges of the casing are brought together just underneath the stitching machine. At this point, the stitching machine sews the edges of the casing together and the completed tube can be conveyed away from the apparatus.

The apparatus creates a continuous tubular sandbag. If separate sandbags are desired, one can cut the completed tube into desired lengths and seal the edges with a portable sewing machine at the desired location. However, several large tubes are desirable to many small sandbags, because they are easier to transport away from the flood site once the flood danger has passed.

In another embodiment, the casing is already in tubular form and is disposed in a toric roll and supported on a crane mounted on the platform. The casing can be unrolled from the roll in a vertical direction. The hopper is arranged directly above the roll and dispenses a quantity of sand into an interior of the casing as the casing is unrolled from the roll. There is only a need for a single conveyor, which conveys the casing filled with sand off of the platform. This conveyor is mounted an another crane.

The invention also includes a method for constructing and depositing sandbags, comprising providing a length of casing on a roll, unrolling the casing on a conveyor, the casing having two longitudinal edges, depositing sand on top of the unrolled casing via hopper, bringing edges of the casing together after the sand has been deposited, stitching the edges of the casing together to form a tube filled with sand, and conveying the tube to a desired location via a second conveyor.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
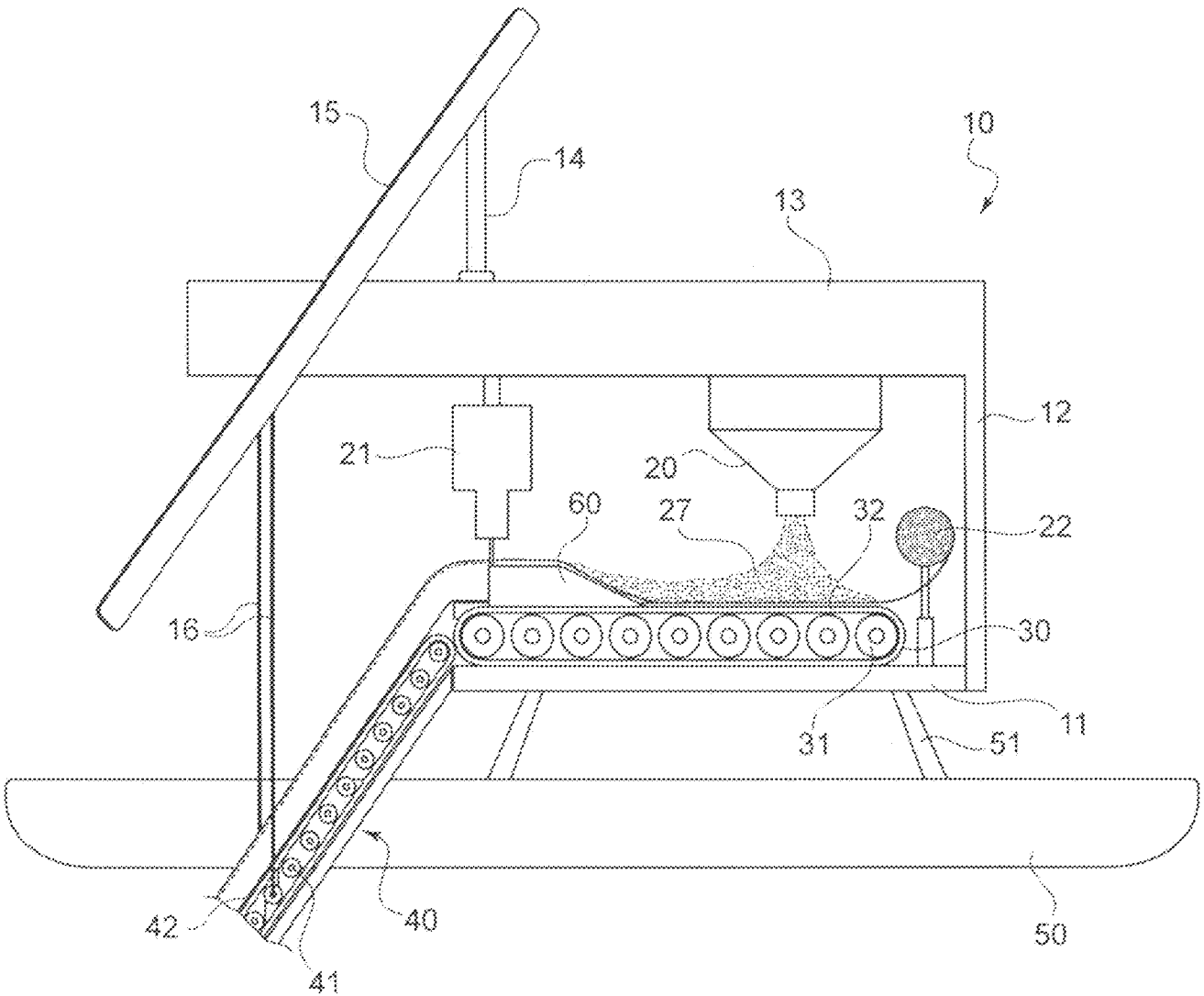
FIG. 1 shows a side view of one embodiment of the apparatus according to the invention.
Figure 2:
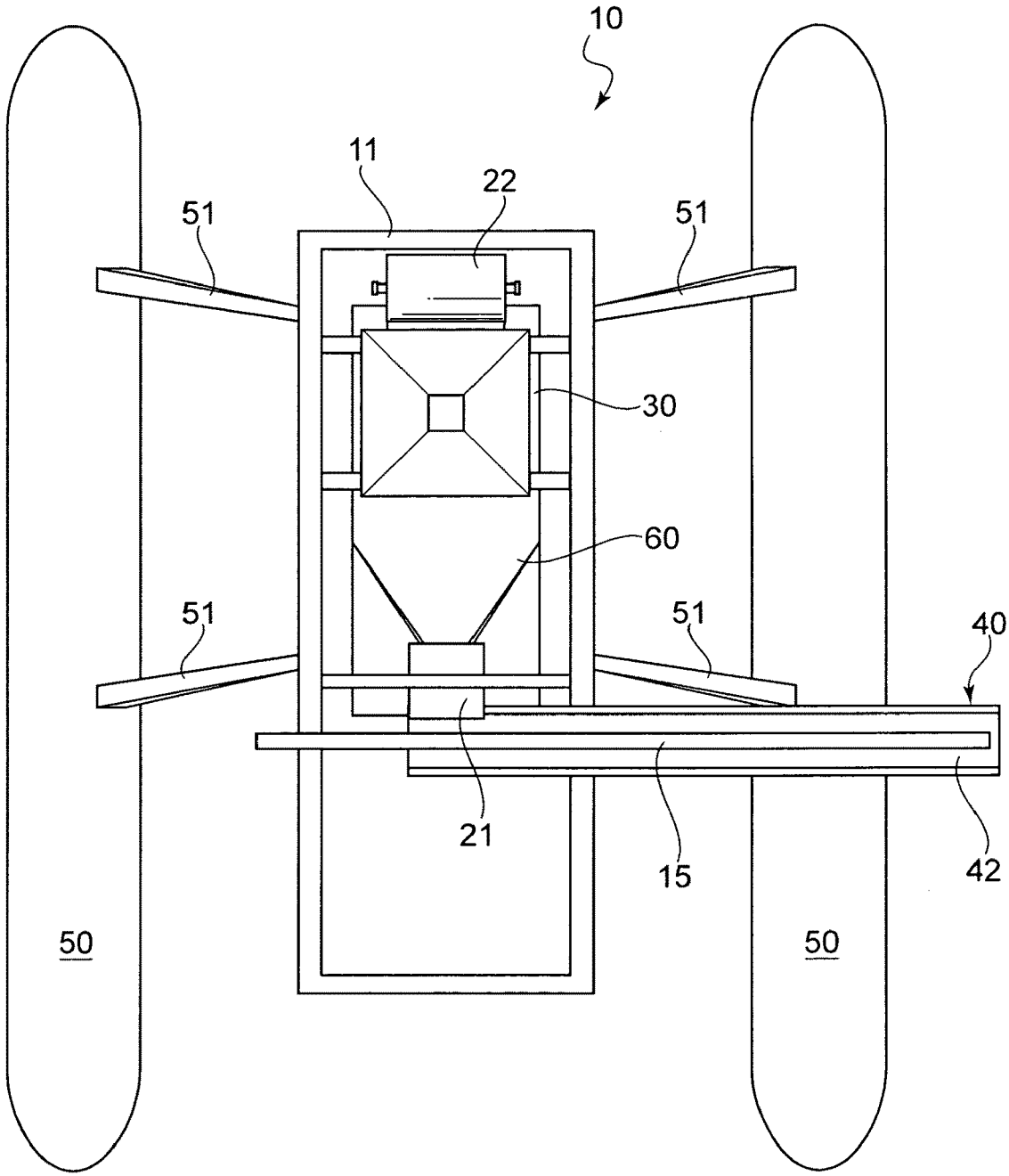
FIG. 2 shows a top view thereof.
Figure 3:
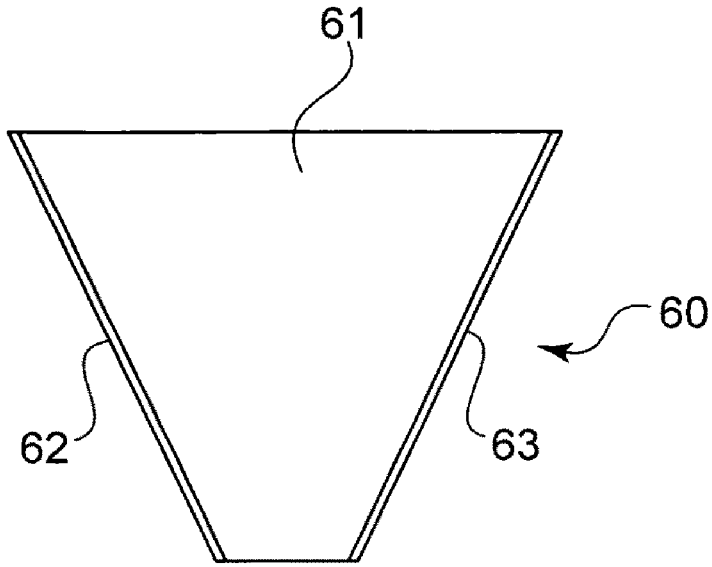
FIG. 3 shows a top view of a device for bringing the edges of the casing together.
Figure 4:
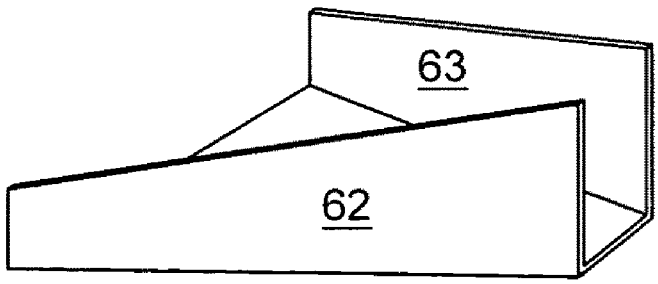
FIG. 4 shows a side view of the device shown in FIG. 3.

Referring now in detail to the drawings, FIGS. 1-4 show a first embodiment of the apparatus according to the invention. Apparatus 10 consists of a platform 11 supported on pontoons 50 by struts 51, and cranes 12, 14 mounted on platform 11. Crane 12 has a boom 13 and crane 14 has a boom 15. Cranes 12, 14 can be tower cranes. Boom 15 is rotatable through a 90 degree angle, so that it can rest either parallel or perpendicular to a running direction of apparatus 10.

Disposed on platform 11 is a conveyor 30 consisting of rollers 31 that move a continuous belt 32. Mounted at the head of conveyor 30 is a roll of casing 22. Casing 22 can be made of any suitable covering material for a sandbag, such as burlap, polypropylene, etc. Casing 22 is unwound onto conveyor 30 and transported along conveyor 30. A hopper 20 is mounted on boom 13 above conveyor 30. Hopper 20 contains sand 27 that can be dispensed through a bottom opening onto casing 22 as it travels along conveyor 30. Casing 22 then enters device 60. Device 60, which is shown in detail in FIGS. 3 and 4, consists of a substantially trapezoidal shaped element having two vertical side walls 62, 63. Casing 22 enters element 60 at the wider end, and is squeezed as it travels toward the narrower end, thus pushing the longitudinal edges of casing 22 upward and together. At this point, as shown in FIG. 1, the edges of casing 22 can be easily stitched together by an industrial stitching machine 21, which is supported by boom 13 and positioned at the narrower end of device 60.

After the edges have been sewn together, casing 22 now forms a tube filled with sand 27, and takes the form of a single continuous sandbag. Casing 22 is then transported away by conveyor 40, which consists of rollers 41 and a belt 42, which are supported by cables 16 on boom 15. Due to the adjustability of boom 15, conveyor 40 can be positioned so that it carries casing 22 away in a direction perpendicular to the traveling direction of apparatus 10. This allows continuous placement of filled casing 22 along a bank as apparatus 10 moves along the shoreline, thus eliminating the need for manual placement of sandbags.

Figure 5:
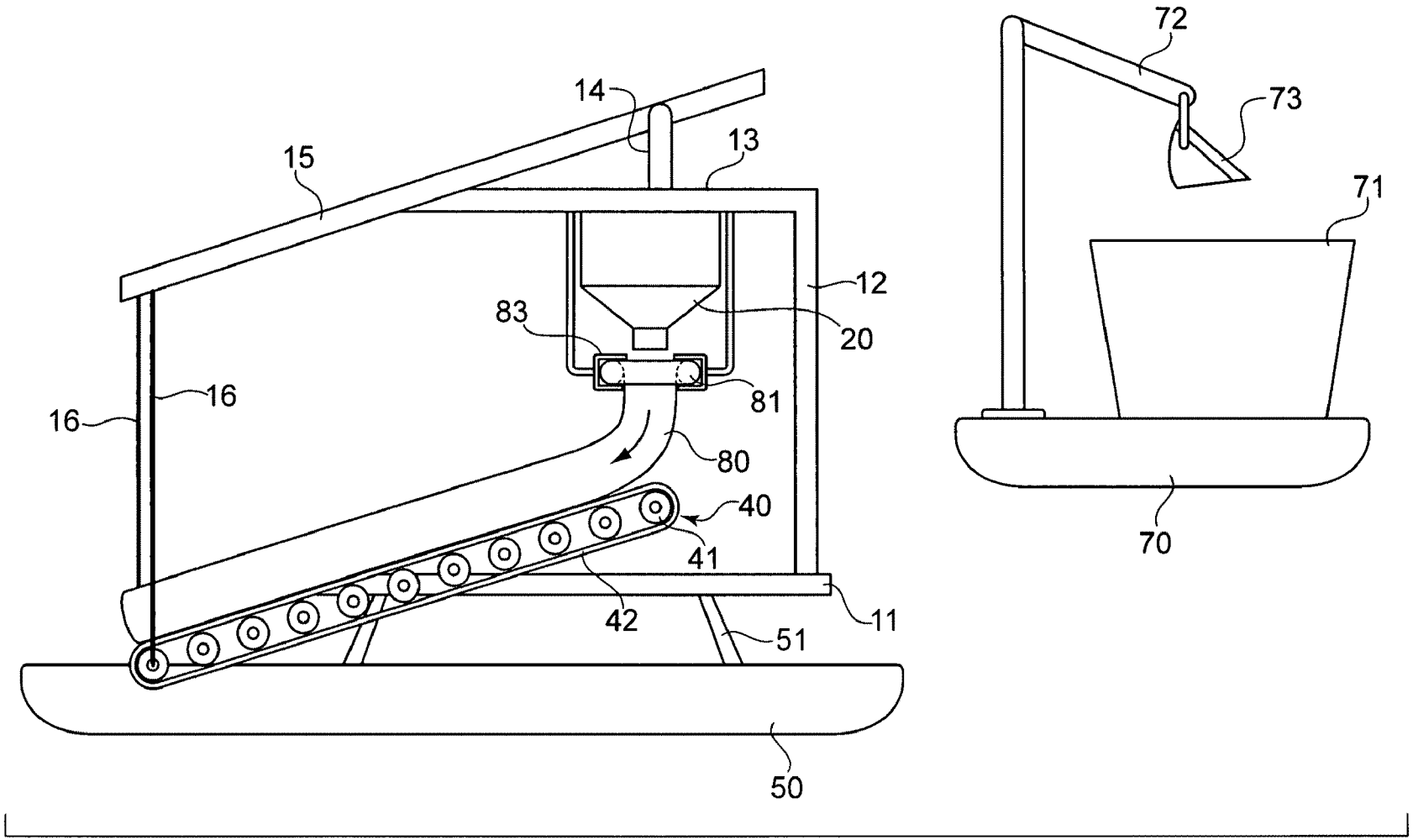
FIG. 5 shows a side view of an alternative embodiment of the device according to the invention.
Figure 6:
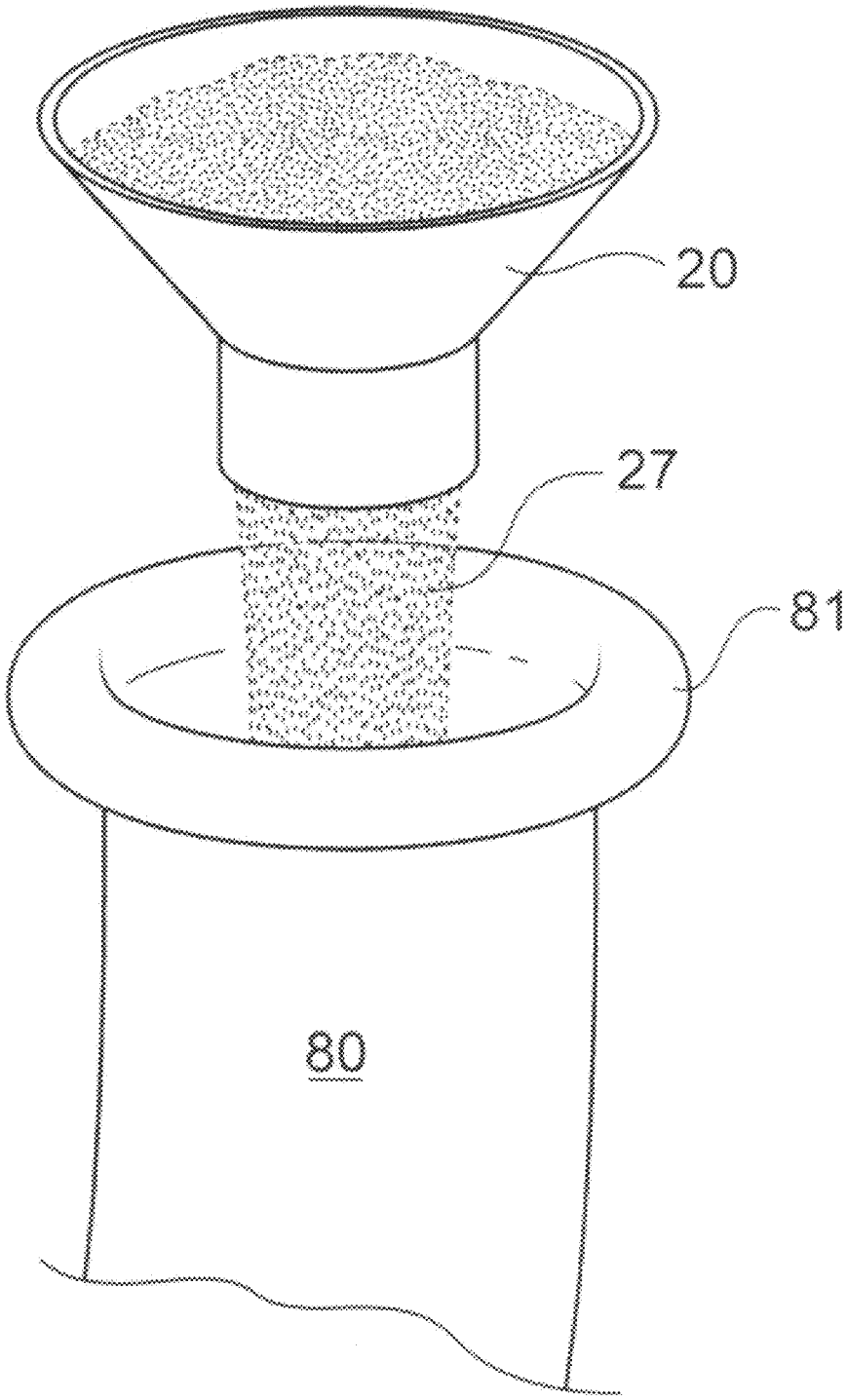
FIG. 6 shows a close-up view of the roll of casing and hopper from the embodiment of FIG. 5.

An alternative embodiment of apparatus 10 is shown in FIGS. 5 and 6. Here, conveyor 30 is eliminated, and the casing takes the form of a tubular casing 80, which is rolled in a toric roll 81, positioned directly underneath hopper 20 and mounted via frame structure 83 on boom 13. Hopper 20 dispenses sand 27 directly into the center cavity of roll 81, where it fills tubular casing 80. Tubular casing 80 is then transported away by conveyor 40 in the manner described above with regard to FIGS. 1-4. The embodiment shown in FIGS. 5 and 6 has the advantage of few moving parts and thus a low risk of complications and breakdowns.

A separate floatable platform 70 is provided with a hopper 71 for storing extra sand 27. Crane 72 contains filling device 73 which can scoop sand from hopper 71 and deposit it in hopper 20 when hopper 20 runs low.

Figure 7:
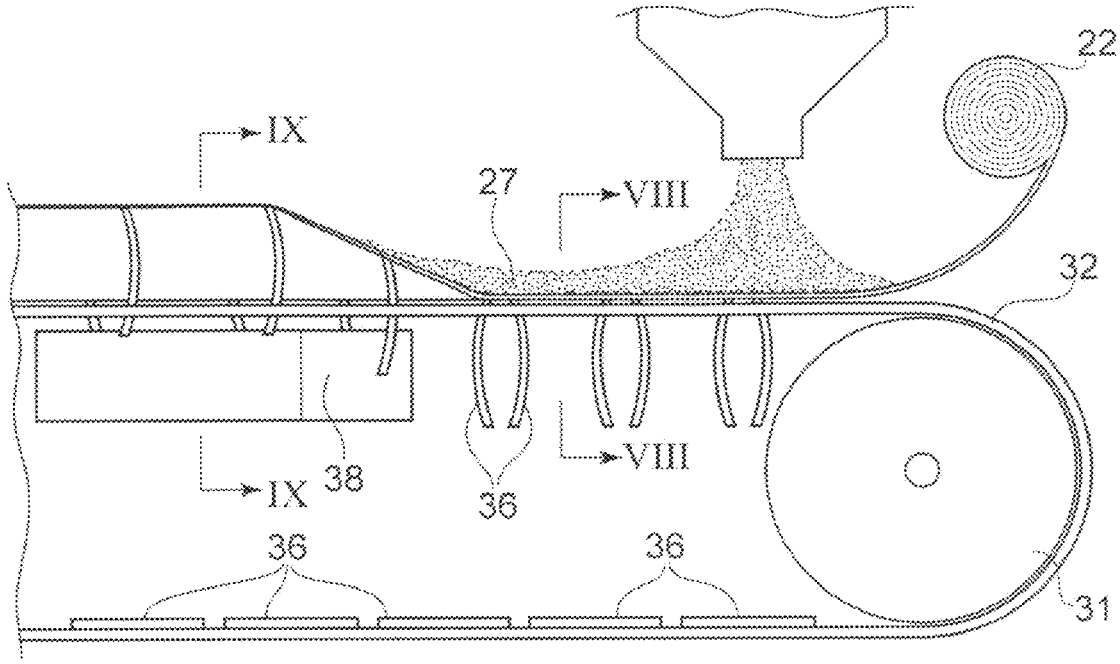
FIG. 7 shows a side view of a conveyor with hooks for bringing the edges of the casing together.
Figure 8:
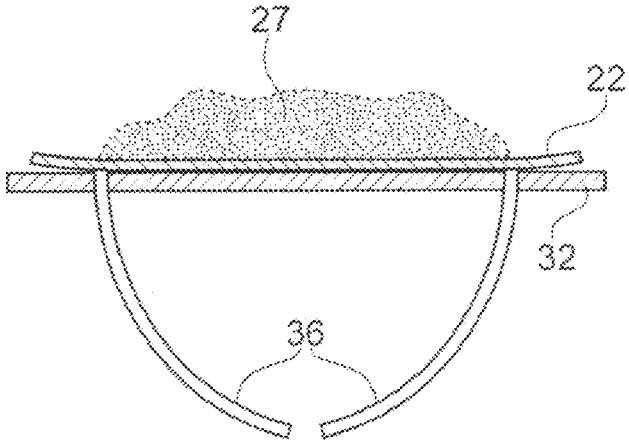
FIG. 8 shows a cross-sectional view of the conveyor of FIG. 7 along lines VIII-VIII.
Figure 9:
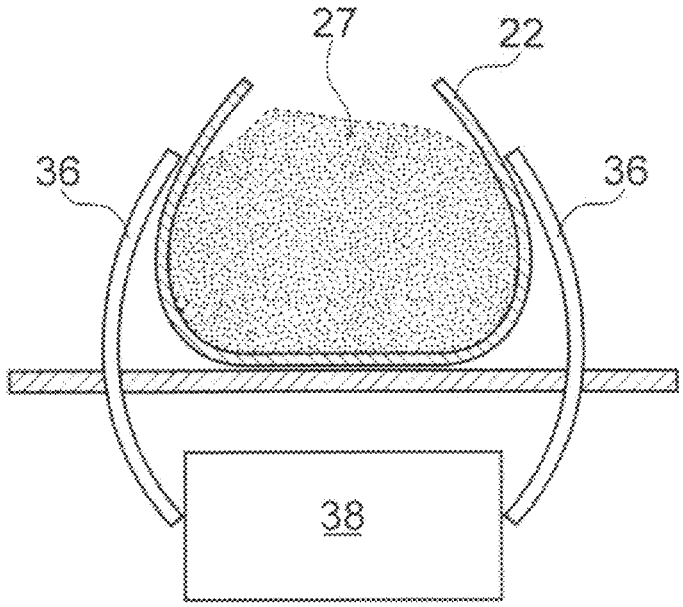
FIG. 9 shows a cross-sectional view of the conveyor of FIG. 7 along lines IX-IX.

FIGS. 7-10 illustrate another embodiment of the invention, showing an alternative way to bring edges of a flat casing together. A series of hooks 36 are connected to belt 31 and are slidable through a hole in belt 32 so that they can be pushed upward through belt 32. Hooks 36 hang below belt 32, along the longitudinal edges of belt 32, in a resting state, as shown in FIG. 8. As belt 32 travels along conveyor 30, hooks 36 encounter stationary bar 38, which is mounted underneath belt 32. Bar 38 pushes against the bottoms of hooks 36 and pushes them up through belt 32. This causes the top of hooks 36 to push the edges of casing 22 upward and together, around sand 27, as shown in FIGS. 7 and 9. The weight of sand 27 keeps casing 22 in place along conveyor 22. Once the edges of casing 22 are pushed together, they can be sewn shut by stitching machine 21 (shown in FIG. 1) to form a tube filled with sand.

Figure 10:
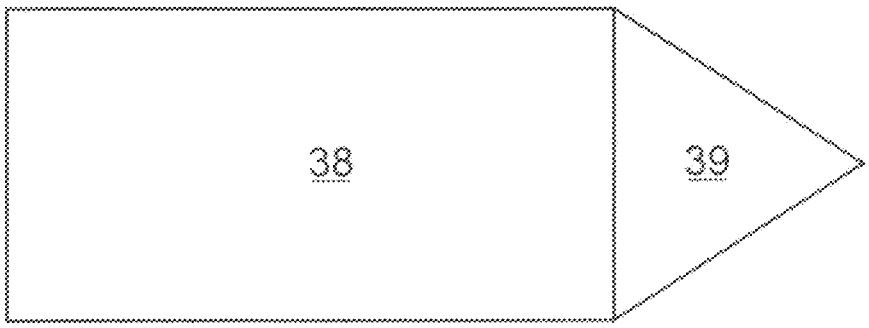
FIG. 10 shows a top view of the stationary bar of the embodiment shown in FIG. 7.

To enable bar 38 to smoothly push hooks 36 up through belt 32 without hooks 36 becoming caught, bar 38 has a tapered front end 39, shown in FIG. 10, which allows hooks to encounter the tip of end 39 and be gradually pushed upward by the slanted edges, until a full width of bar 38 is reached. Once hooks pass bar 38, they slide back down underneath belt 32. The force of gravity keeps hooks 36 lying flat as belt 32 travels around and back to roller 31.

Instead of having platform 11 be supported by pontoons, the entire system could be mounted on a chassis with wheels for land transport.

Accordingly, while only a few embodiments of the present invention have been shown and described, it is obvious that many changes and modifications may be made thereunto without departing from the spirit and scope of the invention.

What is claimed is:

1. An apparatus for constructing sandbags, comprising: a floatable platform;

means for moving the floatable platform in a desired direction;

a length of casing disposed in a roll and supported on the platform, said casing having two longitudinal edges and being adapted to be unrolled from the roll;

a hopper for receiving and dispensing a quantity of sand on top of the casing as the casing is unrolled from the roll, said hopper being disposed above the length of casing;

a device for bringing the longitudinal edges of the casing together;

a stitching machine, for stitching the edges of the casing together to form a tube of casing, said stitching machine being disposed on the platform above the device for bringing the edges of the casing together to form a closed tube; and a conveyor for conveying the tube away from the stitching machine and off of the platform.

2. The apparatus according to claim 1, further comprising a crane supporting the conveyor, said crane adapted to rotate the conveyor between a position where the conveyor has a running direction that is perpendicular to a moving direction of the platform and a position where the running direction is parallel to the moving direction of the platform.

3. The apparatus according to claim 2, further comprising an additional crane connected to the platform, said additional crane supporting the hopper and stitching machine.

4. The apparatus according to claim 1, further comprising a second floatable platform, said second floatable platform containing a quantity of sand; and a device for transferring the quantity of sand to the hopper.

5. The apparatus according to claim 1, wherein the floatable platform is supported by pontoons.

6. The apparatus according to claim 1, further comprising a second conveyor having rollers and a belt for receiving the casing from the roll and transporting the casing past the hopper, through the device for bringing the edges of the casing together, and through the stitching machine to the conveyor.

7. The apparatus according to claim 6, wherein the device for bringing the edges of the casing together comprises a plurality of hooks connected to the second conveyor belt adjacent longitudinal edges of the belt, said second conveyor belt having apertures through which each hook can extend, and a stationary bar mounted below the second conveyor belt, wherein when the belt is moving, the hooks contact the stationary bar and move upward through a respective one of the apertures in the belt, and bring the longitudinal edges of the belt together.

8. The apparatus according to claim 1, wherein the device for bringing the edges of the casing together comprises a structure having a flat substantially trapezoidal bottom, two non-parallel side walls and two open ends, with one open end being wider and the other open end being narrower, so that casing entering the structure from the wider end is squeezed together as it exits the narrower end and the ends of the casing are brought together.

9. An apparatus for constructing sandbags, comprising: a floatable platform; means for moving the floatable platform in a desired direction; a length of tubular casing disposed in a toric roll and supported on the platform, said casing being adapted to be unrolled from the roll; a hopper for receiving and dispensing a quantity of sand into an interior of the casing as the casing is unrolled from the roll, said hopper being disposed above the roll of casing; and a conveyor for conveying the casing filled with sand off of the platform.

10. The device according to claim 9, further comprising a crane mounted on the platform, said crane supporting the conveyor and being adapted to rotate the conveyor.

11. The device according to claim 10, further comprising an additional crane mounted on the platform, said additional crane supporting the hopper.

* * * * *